US010017970B2

(12) United States Patent
Shimura et al.

(10) Patent No.: US 10,017,970 B2
(45) Date of Patent: Jul. 10, 2018

(54) MOTOR VEHICLE DOOR LATCH DEVICE

(71) Applicant: MITSUI KINZOKU ACT CORPORATION, Yokohama-shi, Kanagawa (JP)

(72) Inventors: Ryoji Shimura, Yokohama (JP); Hajime Yoneyama, Yokohama (JP)

(73) Assignee: Mitsui Kinzoku Act Corporation, Yokohama-shi (JP)

( * ) Notice: Subject to any disclaimer, the term of this patent is extended or adjusted under 35 U.S.C. 154(b) by 646 days.

(21) Appl. No.: 14/426,218

(22) PCT Filed: Sep. 3, 2013

(86) PCT No.: PCT/JP2013/073662
§ 371 (c)(1),
(2) Date: Mar. 5, 2015

(87) PCT Pub. No.: WO2014/038540
PCT Pub. Date: Mar. 13, 2014

(65) Prior Publication Data

US 2015/0233158 A1 Aug. 20, 2015

(30) Foreign Application Priority Data

Sep. 7, 2012 (JP) ..... 2012-197234
Mar. 14, 2013 (JP) ..... 2013-051447

(51) Int. Cl.
*E05C 3/06* (2006.01)
*E05B 85/24* (2014.01)

(52) U.S. Cl.
CPC ..... *E05B 85/243* (2013.01); *Y10T 292/108* (2015.04); *Y10T 292/1075* (2015.04)

(58) Field of Classification Search
CPC ..... E05B 85/26; E05B 77/36; E05B 77/38; E05B 81/14; E05B 85/20; E05B 17/0045;
(Continued)

(56) References Cited

U.S. PATENT DOCUMENTS 4,856,829 A * 8/1989 Nakamura ..... E05B 77/36 292/216
8,376,419 B2 2/2013 Konomoto et al.
(Continued)

FOREIGN PATENT DOCUMENTS

JP 03-055373 A 3/1991
JP 6-1022 B2 1/1994
(Continued)

OTHER PUBLICATIONS

International Search Report Corresponding to PCT/JP2013/073662 dated Dec. 10, 2013.

*Primary Examiner* — Mark A Williams
(74) *Attorney, Agent, or Firm* — Davis & Bujold PLLC; Michael J. Bujold

(57) ABSTRACT

A motor vehicle door latch device which comprises a body, a latch and a pawl. The pawl engages with the latch to prevent the latch from turning. The pawl comprises a core and a synthetic-resin portion. A releasing portion is disposed on a basic axial portion of a core. The releasing portion is formed together with the core or the synthetic-resin portion in order to reduce the associated manufacturing costs and weight of the device.

4 Claims, 5 Drawing Sheets

(58) Field of Classification Search
CPC ..... Y10T 292/0949; Y10T 292/108; Y10T 292/0932; Y10T 292/1059; Y10T 292/68; Y10T 292/683; Y10T 292/688; Y10S 292/56; Y10S 292/73
See application file for complete search history.

(56) References Cited

U.S. PATENT DOCUMENTS

| | | | | |
|---|---|---|---|---|
| 2001/0015558 | A1* | 8/2001 | Fisher | E05B 77/10 292/216 |
| 2001/0050484 | A1* | 12/2001 | Kobayashi | E05B 85/26 292/216 |
| 2004/0012468 | A1 | 1/2004 | Hyp | |
| 2012/0091738 | A1* | 4/2012 | Coleman | E05B 85/26 292/200 |
| 2014/0284941 | A1* | 9/2014 | Wittelsbuerger | E05B 77/06 292/92 |

FOREIGN PATENT DOCUMENTS

| | | | |
|---|---|---|---|
| JP | 2011-017172 | A | 1/2011 |
| WO | 2009/047996 | A1 | 4/2009 |

* cited by examiner

MOTOR VEHICLE DOOR LATCH DEVICE

FIELD OF THE INVENTION

The present invention relates to a motor vehicle door latch device in which a pawl engages with a latch.

BACKGROUND OF THE INVENTION

Conventionally, a motor vehicle door latch device comprises a latch that is engagable with a striker; a pawl that prevents the latch from turning; and an opening lever that transmits an opening operation of a handle to the pawl which turns in a releasing direction or in a disengaging direction of the pawl from the latch. In JP6-1011B2, the pawl comprises a core that comprises a basic axial portion and a pawl portion formed from stamping of metal and perpendicular to each other, synthetic resin being molded over the core.

However, in the foregoing motor vehicle door latch device, the opening lever is fixed to the end of the pawl by crimping to turn together with the pawl thereby increasing the number of parts and fixing operation of the opening lever to increase manufacturing costs.

SUMMARY OF THE INVENTION

In view of the disadvantages, it is an object of the present invention to provide a motor vehicle door latch device that reduces manufacturing costs and weight.

DETAILED DESCRIPTION OF THE PREFERRED EMBODIMENTS

Figure 1:
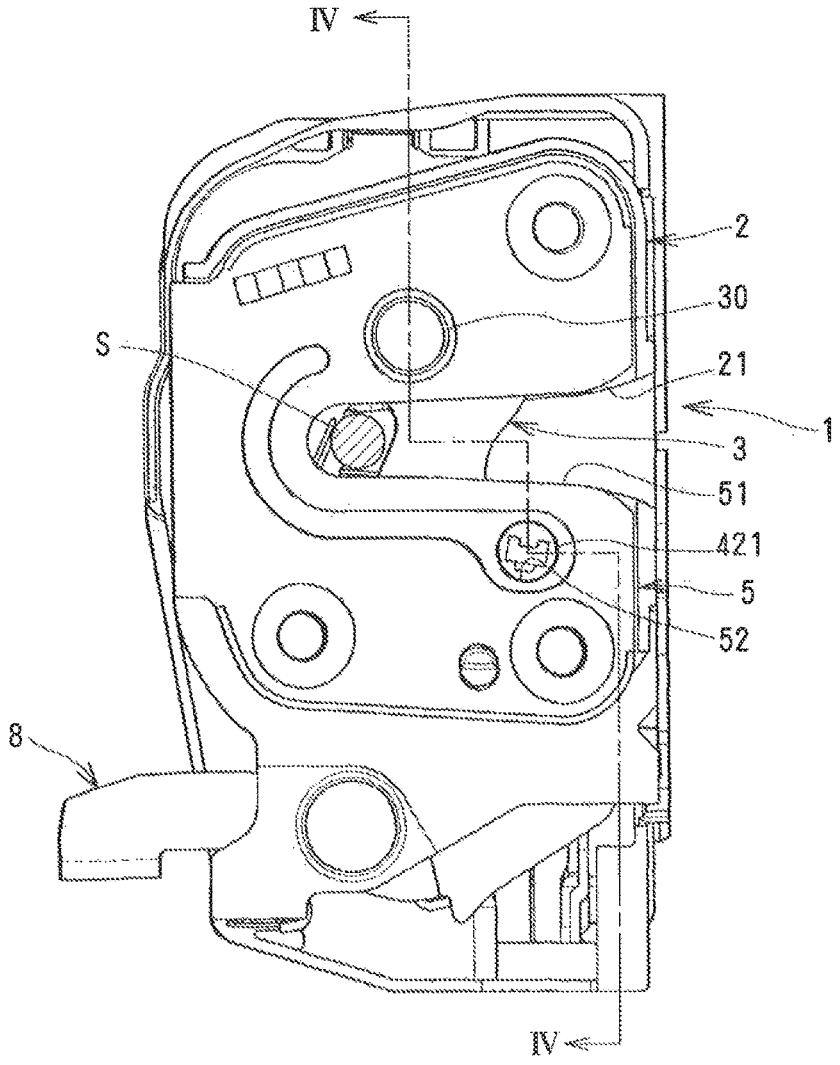
FIG. 1 is a front elevational view of a door latch device according to the present invention.

One embodiment of the present invention will be described with respect to the drawings. A door latch device 1 is fixed with a plurality of bolts (not shown) to the rear end in a door of a motor vehicle. The door latch device 1 comprises a synthetic-resin box-like body 2 having a groove 21 into which a striker S is capable of coming; a latch 3 pivotally coupled via a latch shaft 30 in the body 2 to engage with the striker when the door is closed; and a pawl 4 that selectively engages with a half-latch engagement portion 31 or a full-latch engagement portion 32 on the outer circumference of the latch 3 that engages with the striker S and prevents the latch 3 from turning in an opening direction or a counterclockwise direction in FIGS. 1 and 2.

Figure 6:
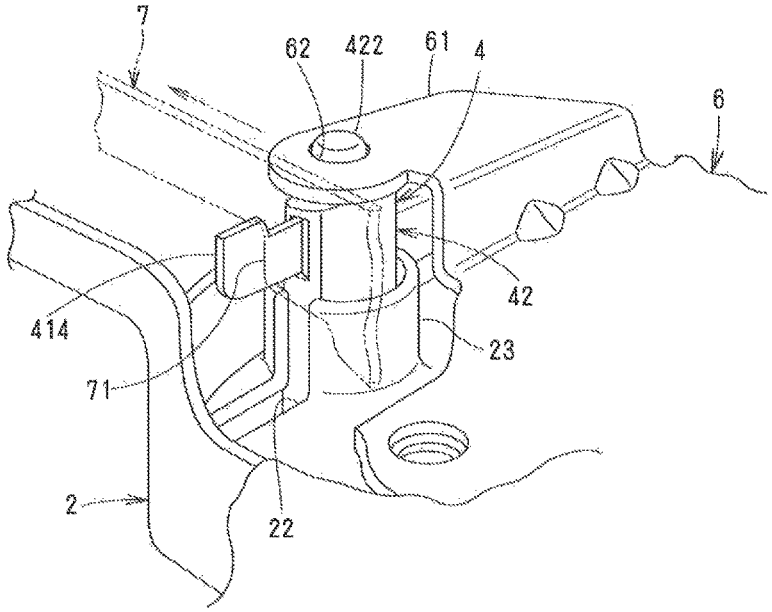
FIG. 6 is a perspective view in which the back of the door latch device is seen obliquely.

A metal cover member 5 is fixed to close the front of the body 2 and has a groove 52 into which the striker S comes when the door is closed. A metal back member 6 is fixed to the back of the body 2 and comprises a handle-moving lever 8 that is capable of turning in a releasing direction or a counterclockwise direction in FIG. 1 with a handle (not shown) for opening the door on the door, and a releasing lever 7 that moves with the handle-moving lever 8 in a releasing direction or a direction of arrow in FIG. 6.

Figure 2:
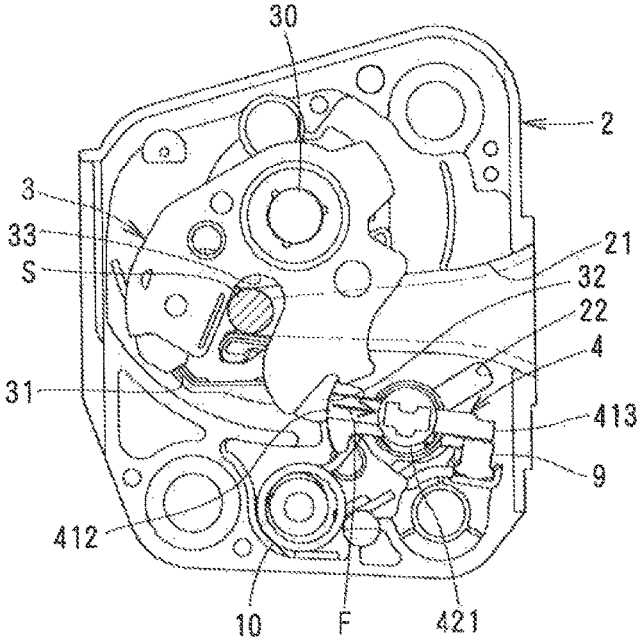
FIG. 2 is a front elevational view of the door latch device from which a cover member is removed.
Figure 3:
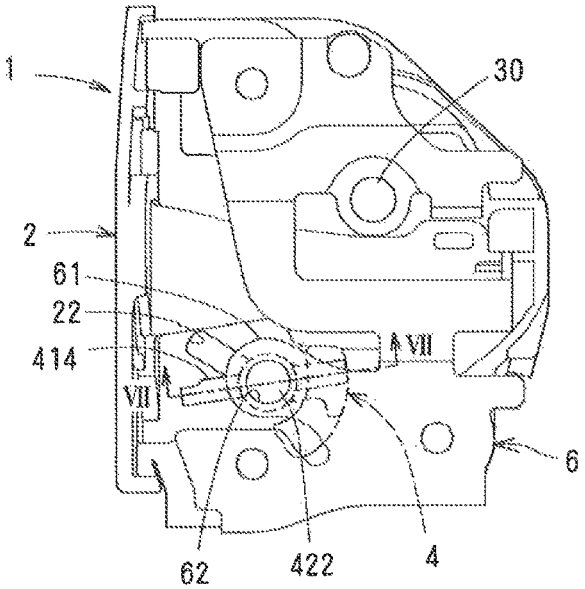
FIG. 3 is a back elevational view of the door latch device.

When the door is opened, the latch 3 is in an open position to which it turns counterclockwise from the full-latch position in FIG. 2 by about 90 degrees. When the door is closed, the striker S that comes in the grooves 21, 51 from the right side in FIG. 2 engages in a U-shaped groove 33. The latch 3 turns clockwise from the open position at a certain angle to the full-latch position in FIG. 2 via the half-latch position between the open position and the full-latch position. When the latch 3 turns to the full-latch position, the pawl 4 engages with the full-latch engagement portion 31 of the latch 3 thereby preventing the latch 3 from turning from the half-latch position to the full-latch position.

Figure 5:
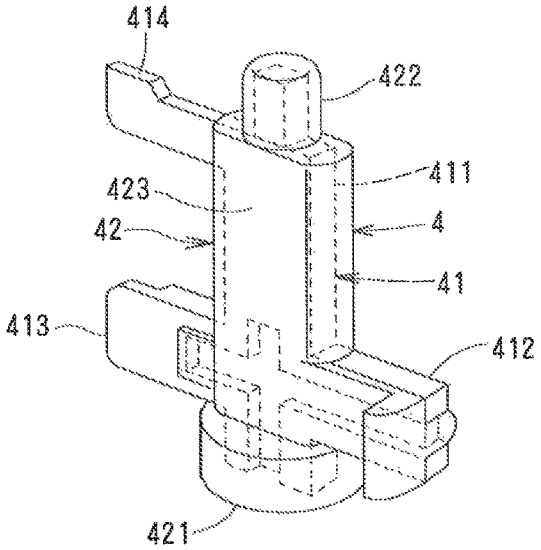
FIG. 5 is a perspective view of a pawl.
Figure 7:
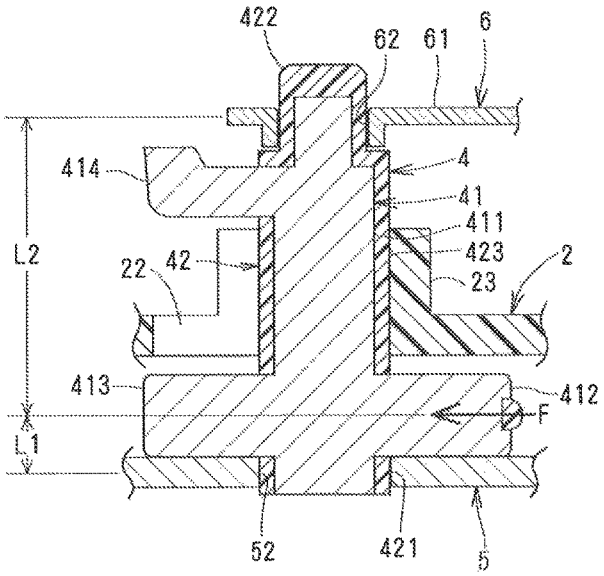
FIG. 7 is a cross-sectional view taken along the line VII-VII in FIG. 3.

As shown in FIGS. 5 and 7 mainly, the pawl 4 comprises a core 41 formed by press stamping of metal, and a rigid synthetic-resin portion 42 for molding the main part of the core 4.

In FIGS. 5 and 7, the core 41 comprises a basic axial portion 411 along an axis of the pawl 4; a pawl portion 412 disposed close to one end of the basic axial portion 411 or the lower part in FIGS. 5 and 7 perpendicular to the basic axial portion 4 to selectively engage with the half-latch engagement portion 31 or full-latch engagement portion 32 of the latch 3; and a releasing portion 414 disposed close to the other end of the basic axial portion 411 or the upper part in FIGS. 5 and 7 perpendicular to the basic axial portion 411.

The synthetic-resin portion 41 is continuously molded around the basic axial portion 411 of the core 41 except the pawl portion 412 with which the latch 3 comes in contact in a turning direction.

At one and the other ends of the basic axial portion 411 of the core 41, there are formed a first axial portion 421 which is rotatably disposed in an axial hole 52 of the cover member 5 and cylindrically molded in the synthetic-resin portion 42 and a second axial portion 422 rotatably disposed in an axial hole 62 of a support 61 of the back member 6 fixed at the back of the body 2. An intermediate portion 423 between the first axial portion 421 and the second axial portion 422 of the basic axial portion 411 of the core 41 is rotatably disposed in a cylindrical portion 23 of the body 2 and molded in a rectangular strut to facilitate molding of the synthetic resin and lighten.

The support 61 of the back member 5 is bent to form a space from the back surface of the body 2. The second axial portion 422 is put through the axial hole 62 of the support 61 from the front to the back of the body 2.

The releasing portion 414 of the pawl 4 is formed so that plate thickness faces a rotational direction of the pawl 4 and is rotatably disposed between the back surface of the body 2 and the support 61 of the back member 6. When the pawl 4 is connected to the body 2, a slit 22 is continuously formed with the cylindrical portion 23 to enable the releasing portion 414 to put through from the front to the back so that the releasing portion 414 may be disposed between the back of the body 2 and the support 61. The slit 22 is formed off a direction of load F as shown by an arrow by the latch 3 when the pawl 4 engages in FIG. 2.

In the body 2, there are a stopper 9 made of elastic member such as rubber for stopping the pawl 4 in the engagement position in FIG. 2 where the pawl portion 412 engages with the half-latch engagement portion 31 or full-latch engagement portion 32 of the latch 3 and a spring 10 for biasing the pawl 4 in the engagement direction or a clockwise direction in FIG. 2.

In the pawl 4, the first axial portion 421 and second axial portion 422 are pivotally coupled to the cover member 5 and back member 6 respectively. When the latch 3 turns from the open position to the half-latch position, the pawl portion 412 engages with the half-latch engagement portion 31 of the latch 3 and prevents the latch 3 from turning from the half-latch position to the full-latch position so as to leave the door ajar. When the latch 3 turns to the full-latch position, the pawl portion 412 engages with the full-latch engagement portion 32 of the latch 3 and prevents the latch 3 from turning from the full-latch position in the opening direction so as to hold the door fully closed.

When the door is not fully closed, the releasing lever 7 moves in the releasing direction via the handle-moving lever 8 with the handle. A contact portion 71 of the releasing lever 7 comes in contact with the releasing portion 414 of the pawl 4 from below, and the pawl 4 turns in the releasing direction or counterclockwise direction in FIG. 2 by a certain angle. Hence, the pawl portion 412 disengages from the half-latch engagement portion 31 or full-latch engagement portion 32 of the latch 3 to enable the door to open.

In this embodiment, the metal core 41 that comprises the pawl portion 412, stopped portion 413 and releasing portion 414 is molded together with the synthetic-resin portion 42. It is not necessary to fix a separate opening lever to the end of the core 41 by crimping in the prior art thereby reducing the number of parts, weight and manufacturing costs.

Furthermore, at the other end of the core 41 close to the releasing portion 414, the second cylindrical axial portion 422 is made of synthetic resin and is rotatably coupled to the back member 6 fixed to the back of the body 2 enabling the pawl 4 to be pivotally coupled securely.

Figure 4:
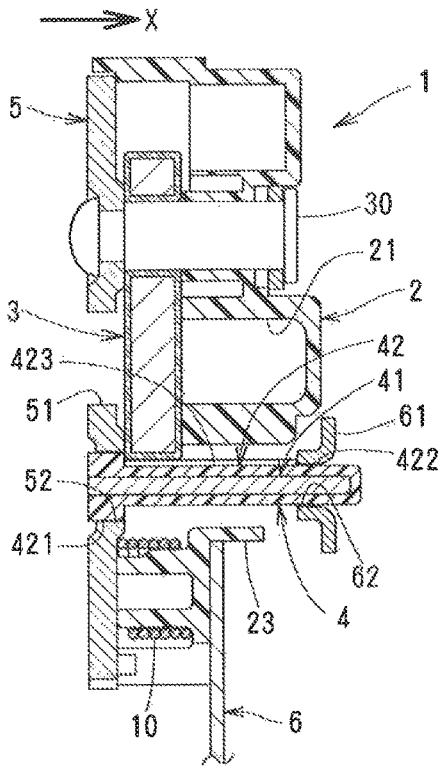
FIG. 4 is a cross-sectional view taken along the line IV-IV in FIG. 1.

The releasing portion 414 is formed together with the pawl 4, and the slit 22 is formed in the body 2. The pawl 4 with the releasing portion 414 and latch 3 are connected from one direction or the front of the body 2 in the same direction or an "X" direction in FIG. 4 into the body 2. The back member 6, body 2, latch 3, pawl 4 and cover member 5 are connected to the latch shaft 30 from the same direction.

With L1<L2 in FIG. 7, most load F can be received by the cover member 5, wherein L1 stands for the distance from the load F by the latch 3 to the cover member 5 and L2 stands for the distance from the load F by the latch 3 to the back member 6. Thus, it is not necessary to improve the strength of the cylindrical portion 23 of the body 2 more than is needed. Hence, the portion of the pawl 4 for pivoting the axial portion 422 can be made of synthetic resin instead of metal.

Figure 8:
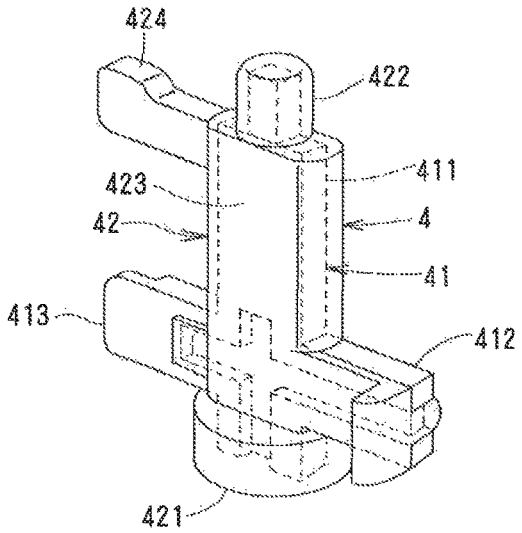
FIG. 8 is a perspective view of another embodiment of a pawl.
Figure 9:
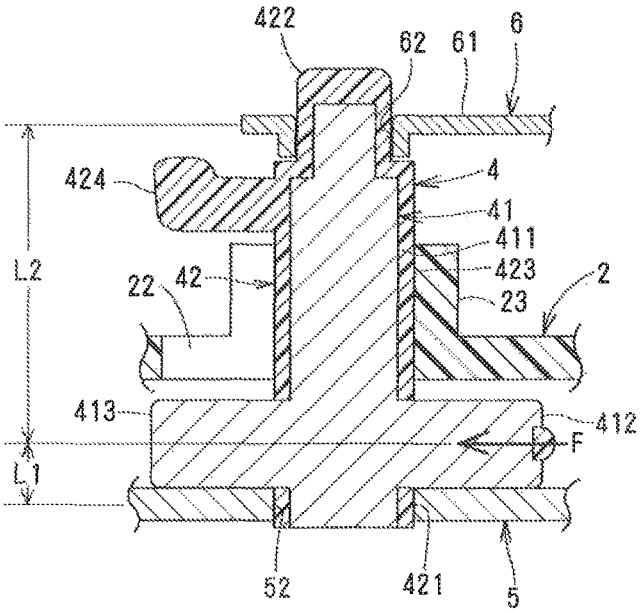
FIG. 9 is a cross-sectional view similar to FIG. 7.

In FIGS. 8 and 9, in another embodiment, a metal core 41 comprises a basic axial portion 411, a pawl portion 412 and a stopped portion 413. A synthetic-resin portion 42 for molding the core 41 comprises a first axial portion 421 that is disposed to rotate in an axial hole 52 of a cover member 5; a second axial portion 422 that is disposed to rotate in an axial hole 62 of a support 61 of a back member 6; and an intermediate portion 423 that are molded together. A releasing portion 424 which can come in contact with a contact portion 71 of a releasing lever 7 when the releasing lever 7 moves in a releasing direction is molded together.

In the embodiment, instead of the structure in which the releasing portion 424 is molded with the core 41 in the foregoing embodiment, the releasing portion 42 is molded with the synthetic-resin portion 42, which achieves similar advantage as in the foregoing embodiment, In the embodiment, except the structure in which the releasing portion 424 is molded with the synthetic-resin portion 42, it is the same as in the foregoing embodiment. The same numerals are allotted to the same members in the foregoing embodiment, and their details are not described.

The foregoing relates to one embodiment of the invention. The following changes may be made without departing from claims as below:

(a) Instead of the structure in which the second axial portion 422 of the pawl 4 is rotatably supported, a synthetic-resin housing for levers may be provided at the back of the body 2, and the second axial portion 422 may be disposed in a bearing of the housing.

(b) The synthetic-resin portion 42 is cylindrically molded between the first axial portion 421 and the second axial portion 422 of the basic axial portion 1 of the core 41.

(c) The cross-section of the first axial portion 421 and/or the second axial portion 422 may be polygonal.

(d) The core 41 of the pawl 4 may be molded by cold-thickness processing or heading.

(e) The releasing lever 7 may be disposed at the side of the housing.

The invention claimed is:

1. A motor vehicle door latch device comprising:

a body;

a latch that is rotatable in the body;

a pawl that is rotatable in a cylindrical portion of the body and engages with the latch to prevent the latch from turning, and a releasing lever that is engageable with the pawl to turn the pawl to disengage from the latch, wherein the pawl comprises: a core part, and a synthetic-resin part that molds the core part, wherein the core part has a basic axial portion made of metal and extends along a rotation axis of the pawl, and a pawl portion extending substantially perpendicular to a length of the basic axial portion close to one end of the basic axial portion and engagable with the latch, and a releasing portion to which the releasing lever contacts and is disposed close to the other end of the basic axial portion to extend substantially perpendicular to the length of the basic axial portion, wherein the synthetic-resin part has a first axial portion, and a second axial portion at least at one end of the basic axial portion and another end opposite the one end, wherein the releasing portion being integrally formed within the core part by the metal, wherein the first axial portion of the pawl is pivotally coupled to a cover member closing a front of the body, the second axial portion of the pawl being pivotally coupled to a back member fixed to a back of the body, wherein the body has a slit in the cylindrical portion through which the releasing portion passes from the front to the back of the body, and wherein the releasing portion being disposed between the back of the body and the back member.

2. The motor vehicle door latch device according to claim 1, wherein, the slit in the cylindrical portion is provided at a position out off a direction of load (F) by the latch when the pawl is engaged.

3. A motor vehicle door latch device comprising:

a body;

a latch that is rotatable in the body;

a pawl that is rotatable in a cylindrical portion of the body and engages with the latch to prevent the latch from turning, and a releasing lever that is engageable with the pawl to turn the pawl to disengage from the latch, wherein the pawl comprises: a core part, and a synthetic-resin part that molds the core part, wherein the core part has a basic axial portion made of metal and extends along a rotation axis of the pawl, and a pawl portion extending substantially perpendicular to a length of the basic axial portion close to one end of the basic axial portion and engagable with the latch, and wherein the synthetic-resin part has a first axial portion, a second axial portion at least at one end of the basic axial portion and another end opposite the one end, and a releasing portion to which the release lever contacts and is disposed close to the other end portion of the basic axial portion to extend substantially perpendicular to the length of the basic axial portion, wherein the releasing portion being integrally formed within the synthetic resin part by the synthetic resin, wherein the first axial portion of the pawl is pivotally coupled to a cover member closing a front of the body, the second axial portion of the pawl being pivotally coupled to a back member fixed to a back of the body, wherein the body has a slit in the cylindrical portion through which the releasing portion passes from the front to the back of the body, and wherein the releasing portion being disposed between the back of the body and the back member.

4. The motor vehicle door latch device according to claim 3, wherein, the slit in the cylindrical portion is provided at a position out off a direction of load (F) by the latch when the pawl is engaged.

* * * * *